US008955692B2

(12) United States Patent
Greenway et al.

(10) Patent No.: US 8,955,692 B2
(45) Date of Patent: Feb. 17, 2015

(54) CLOTHES DRYING DEVICE

(75) Inventors: Douglas D. Greenway, Guelph (CA); Christopher J. Duke, Waterdown (CA)

(73) Assignee: Greenway Home Products Ltd., Guelph (CA)

( * ) Notice: Subject to any disclaimer, the term of this patent is extended or adjusted under 35 U.S.C. 154(b) by 448 days.

(21) Appl. No.: 13/221,146

(22) Filed: Aug. 30, 2011

(65) Prior Publication Data

US 2012/0048820 A1 Mar. 1, 2012

Related U.S. Application Data

(60) Provisional application No. 61/378,630, filed on Aug. 31, 2010.

(51) Int. Cl.
*A47F 3/08* (2006.01)
*D06F 57/04* (2006.01)
*A47B 43/00* (2006.01)

(52) U.S. Cl.
CPC ..... *D06F 57/04* (2013.01)
USPC ..... 211/1.53; 211/197

(58) Field of Classification Search
CPC ..... D06F 57/06; D06F 57/127; D06F 58/14; D06F 57/04; A47F 5/025; A47F 5/05; A47F 5/02; A47F 3/001; F24J 2/5232; F24J 2002/5216
USPC ..... 211/119.001, 196, 197, 1.51, 1.52, 211/1.53, 1.54, 1.55; 34/665, 93
See application file for complete search history.

(56) References Cited

U.S. PATENT DOCUMENTS

| | | | | | |
|---|---|---|---|---|---|
| 1,169,954 | A * | 2/1916 | Halliday | 211/1.53 |
| 2,415,908 | A * | 2/1947 | Pollard | 211/197 |
| 2,821,309 | A * | 1/1958 | Rizzo | 211/197 |
| 2,939,330 | A * | 6/1960 | Margetts | 74/411 |
| 3,002,628 | A * | 10/1961 | Reddell | 211/1.53 |
| 3,144,133 | A * | 8/1964 | Doulos | 211/1.53 |
| 3,997,059 | A * | 12/1976 | Hanneman | 211/1.53 |
| 4,550,840 | A * | 11/1985 | Van Deursen | 211/197 |
| 4,735,322 | A | 4/1988 | Steiner | |
| 5,232,105 | A * | 8/1993 | Gregg | 211/113 |
| 6,948,629 | B1 * | 9/2005 | McClay | 211/196 |
| 7,229,057 | B2 * | 6/2007 | Cavell | 248/343 |
| 7,946,543 | B2 * | 5/2011 | Cotter et al. | 248/159 |
| 2006/0138061 | A1 * | 6/2006 | Thipchuwong et al. | 211/1.54 |
| 2009/0145862 | A1 * | 6/2009 | Yang | 211/1.51 |
| 2012/0138548 | A1 * | 6/2012 | Young | 211/4 |

* cited by examiner

*Primary Examiner* — Patrick Hawn
(74) *Attorney, Agent, or Firm* — Christopher L. Parmelee; Walker & Jocke

(57) ABSTRACT

A clothes drying device is provided that has an elongated support member, and a rack. The rack includes a plurality of arm members that are operative to extend outwardly from the support member in radial directions to support a plurality of clothes lines in spaced apart relation around the support member. The support member may include an upper portion in which a motor is mounted in operative connection with a shaft of a lower portion of the support member. The support member may also include a solar panel mounted thereto. The motor is operative responsive to electrical power generated by the solar panel to cause the rack, solar panel and upper portion of the support member to rotate with respect to the shaft of the lower portion of the support member.

16 Claims, 7 Drawing Sheets

CLOTHES DRYING DEVICE

CROSS-REFERENCE TO RELATED APPLICATIONS

This application claims benefit under 35 U.S.C. §119(e) of Provisional Application No. 61/378,630 filed Aug. 31, 2010, the disclosure of which is incorporated herein by reference in its entirety.

BACKGROUND

Laundry processes for clothing often employ the use of a drying device to remove residue water from clothing articles. To reduce energy requirements, wet clothing articles may be placed on a drying rack outside in order for water to evaporate naturally via sunlight and fresh air. However, the efficiency of such drying racks may vary significantly based on factors outside the user's control, such as high humidity. Thus, there is a need for improvement to existing drying devices.

SUMMARY

The following is a brief summary of subject matter that is described in greater detail herein. This summary is not intended to be limiting as to the scope of the claims.

Described herein are various technologies relating to clothes drying devices which provide increased efficiency and/or drying processing speeds. An example system may include a clothing drying device with a shape that resembles an umbrella. Such a device may include a rack capable of supporting a plurality of clothing articles thereon in place of the canopy associated with a typical umbrella. The rack may extend around a vertical support member such as a pole or tube that is operative to support the rack (and the clothing articles attached thereto) above the ground.

In an example embodiment, the rack may be operative to move between a lower compacted closed position (in which the rack is generally folded around the support member) to an upper expanded open position (in which the rack extends farther radially outwardly from the support member compared to its lower compacted closed position). However, it is to be understood that alternative example embodiments may include a drying device in which the rack remains in the described upper expanded open position, and is not operative to fold into a lower compacted closed position.

In these described example embodiments, the support member may include a lower portion that is operative to be mounted in rigid connection with the ground or in a relatively heavy base. Also the support member may include an upper portion that extends upwardly from the lower portion and to which the rack of the umbrella is mounted when in the open position. In example embodiments, the support member includes a motor therein that is operative to cause the upper portion of the support member to rotate the rack relative to the lower portion of the support member. Electrical power for the motor may be provided via a solar panel mounted to the upper portion of the support member above the rack.

On windless days or days with low velocity winds or intermittent winds, the motor is operative to rotate the rack at a speed of several rotations per minute. This rotational speed causes air currents to continuously move across the surfaces of the clothing articles, which in turn causes a relative higher rate of evaporation of water from the clothing articles compared to the cloths being dried on the device without rotation.

Other aspects will be appreciated upon reading and understanding the attached figures and description.

DETAILED DESCRIPTION

Figure 1:
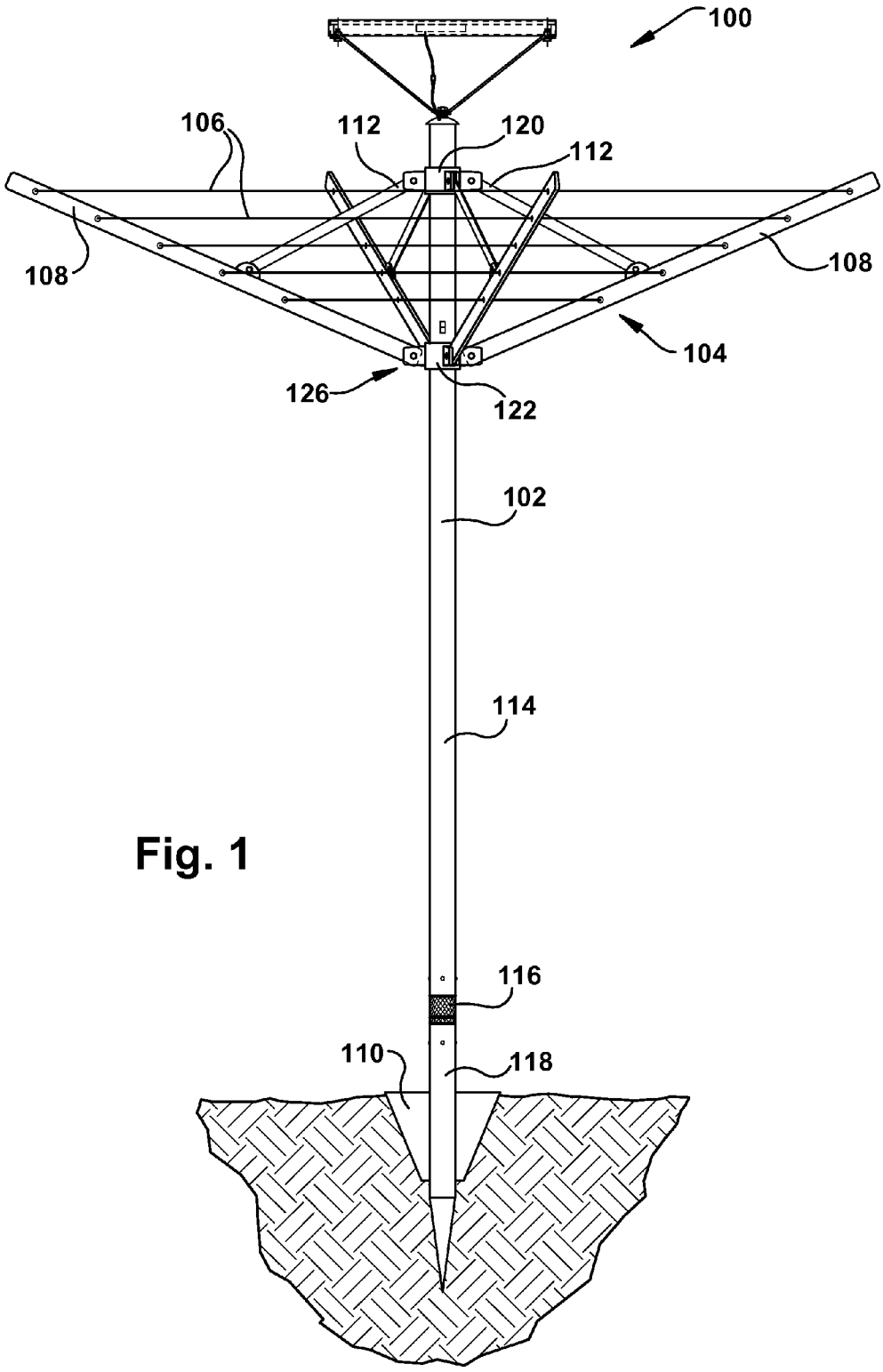
FIG. 1 is a front view of an example embodiment of a clothes drying device in an expanded open position.

Various technologies pertaining to drying devices will now be described with reference to the drawings, where like reference numerals represent like elements throughout. In addition, several functional block and schematic diagrams of example devices are illustrated and described herein for purposes of explanation; however, it is to be understood that functionality that is described as being carried out by certain system components, members, and devices may be performed by multiple components, members, and devices. Similarly, for instance, a component/member/device may be configured to perform functionality that is described as being carried out by multiple components/members/devices.

With reference to FIG. 1, an example clothes drying device 100 that facilitates drying clothing articles is illustrated. The clothes drying device 100 may have the general appearance of an umbrella with a centrally located elongated support member 102 that is operative to support a clothes drying rack 104. Such a rack may have a similar appearance to a canopy of an umbrella. However, rather than serving as a covering (as would be the case with a typical umbrella), the rack 104 includes a plurality of clothes lines 106 to which articles of clothing may be mounted with clothes pins or other fasteners. Such lines may be supported by arm members 108 which extend in radial directions from the support member 102.

Figure 2:
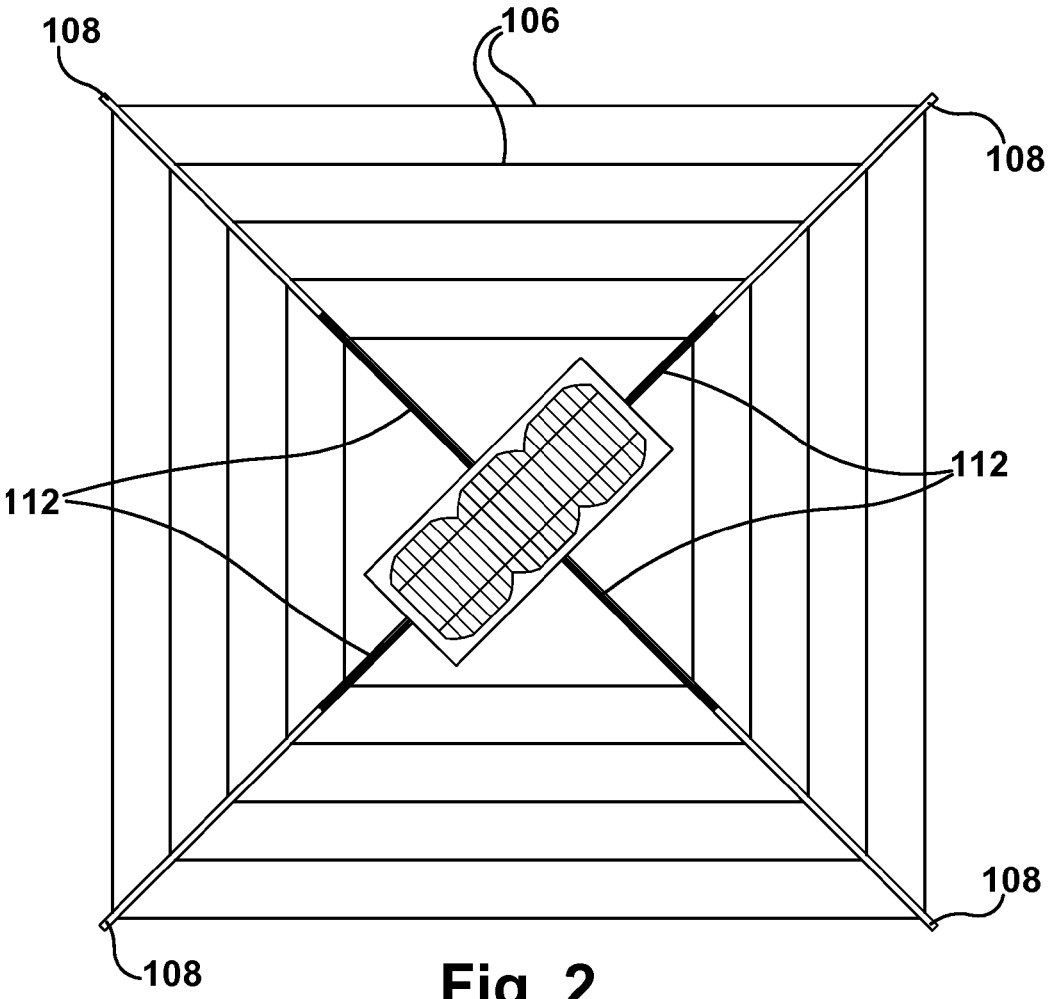
FIG. 2 is a top view of the example embodiment of the clothes drying device in an expanded open position.

As illustrated from a top view perspective in FIG. 2, the clothes lines 106 may be mounted to the arms such that the lines extend in spaced apart relation around the support member 102. For example, the arms may include a plurality of holes therethough and the clothes lines may correspond to flexible lines such as strings, ropes and/or wires that are fastened to the rack by passing through the holes in the arms. However, it is to be understood that in alternative embodiments, the clothes lines 106 may not be flexible, but instead may correspond to separate or connected beams (such as dowels made of wood, plastic, and/or metal) that are mounted to extend in spaced apart relation between the arms 108 of the device 100.

Referring back to FIG. 1, the described device is typically mounted into a foundation 110 such as the ground, a cement form, and/or a suitably heavy stand that is capable of supporting the device in an upright position. Also to support the arm members in the orientation shown in FIG. 1, the device may include a plurality of strut members 112 that extend between the support member 102 and the arm members 108. However, it is to be understood that in alternative embodiments, the arm members 108 may be fastened to the support member with a sufficiently rigid bracket or other mounting arrangement such that the arm members are operatively supported to extend outwardly from the support member without the use of struts.

In an example embodiment, the rack 104 is operative to rotate with respect to the foundation 110. To enable rotation of the rack, the support member 102 of the device may include an upper portion 114 and a lower portion 116 that are operative to rotate with respect to each other. For example, as will be explained in more detail below, the lower portion 116 may include a shaft that extends upwardly into a bore of the upper portion 114 of the support member 102. In this embodiment, the rack 104 is in operative connection with the upper portion 114 of the support member. Also in this described embodiment, the lower portion 116 may be in operative connection with the foundation 110, either directly, or via an extension member 118 such an elongated tube or pipe 118.

Figure 3:
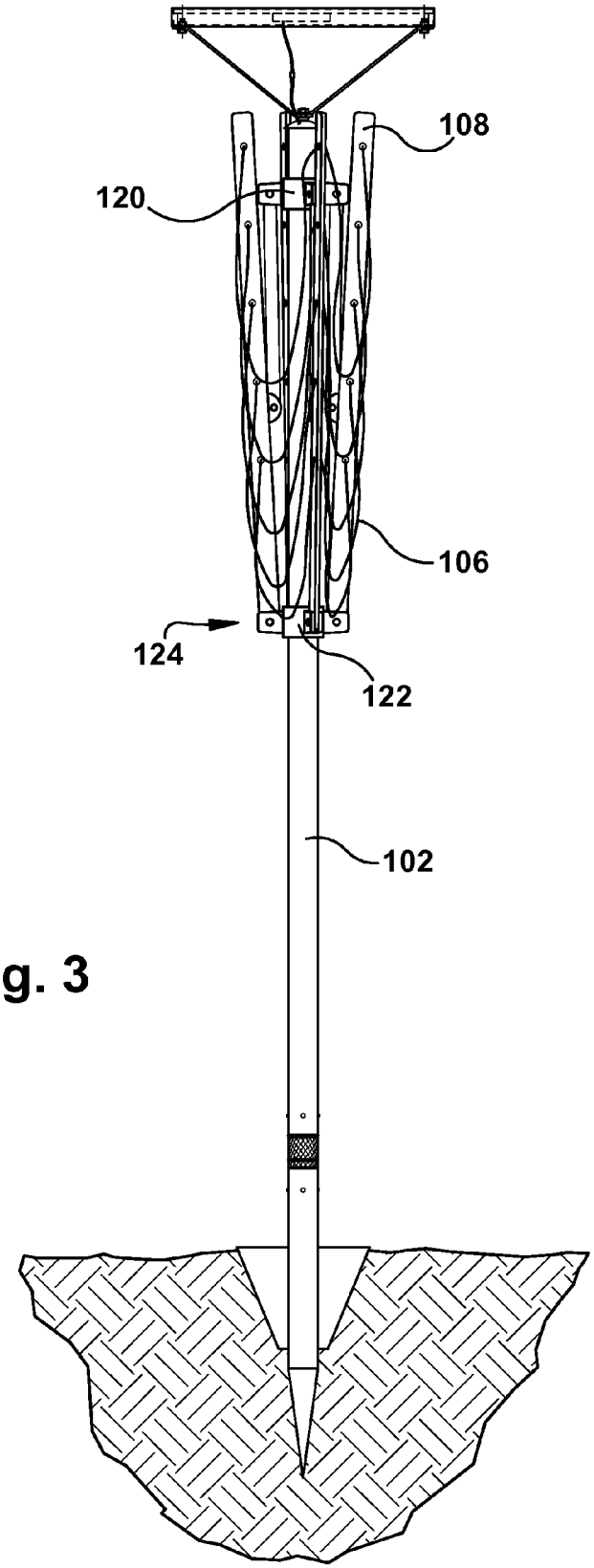
FIG. 3 is a front view of the example embodiment of the clothes drying device in a compacted closed position.

As illustrated in FIG. 3, the strut members, arm members, and support members of the rack may be operatively connected together to enable the rack 104 to fold downwardly along the support member 102. In order to enable the rack to fold downwardly (as illustrated in FIG. 3) or upwardly (as illustrated in FIGS. 1 and 2) the rack may include a head member 120 in operative connection with the upper portion 114 of the support member 102. Also the rack may include a collar member 122 in surrounding relation around the upper portion 114 of the support member below the head member 120. In this described example embodiment, at least the collar member 122 is operative to slide along the upper portion 114 of the support member between a first lower position 124 (shown in FIG. 3) and a second higher position 126 (shown in FIG. 1) that is relatively closer to the head member 120.

In this described embodiment, the arm members 108 are pivotally connected to the collar member 122. Also, strut members 112 are pivotally connected to the head member 120. In addition, each strut member is pivotally connected to a respective one of the plurality of arm members. Thus, when the collar member is in the first lower position 124 (shown in FIG. 3), the arm members and strut members are pivoted with respect to each other and the head member and collar member such that the rack 104 is in a compacted closed position. In this compacted closed position, the clothes lines 106, the arm members 108, and the strut members 112 are adjacent the support member 102. Also, when the collar member 122 is in the second upper position 126 (shown in FIG. 1), the rack 104 is in an expanded open position in which the arm members and strut members are pivoted in order to extend outwardly from the support member in radial directions. In this position, the clothes lines extend in spaced apart relation around the support member (shown in FIG. 2).

Figure 4:
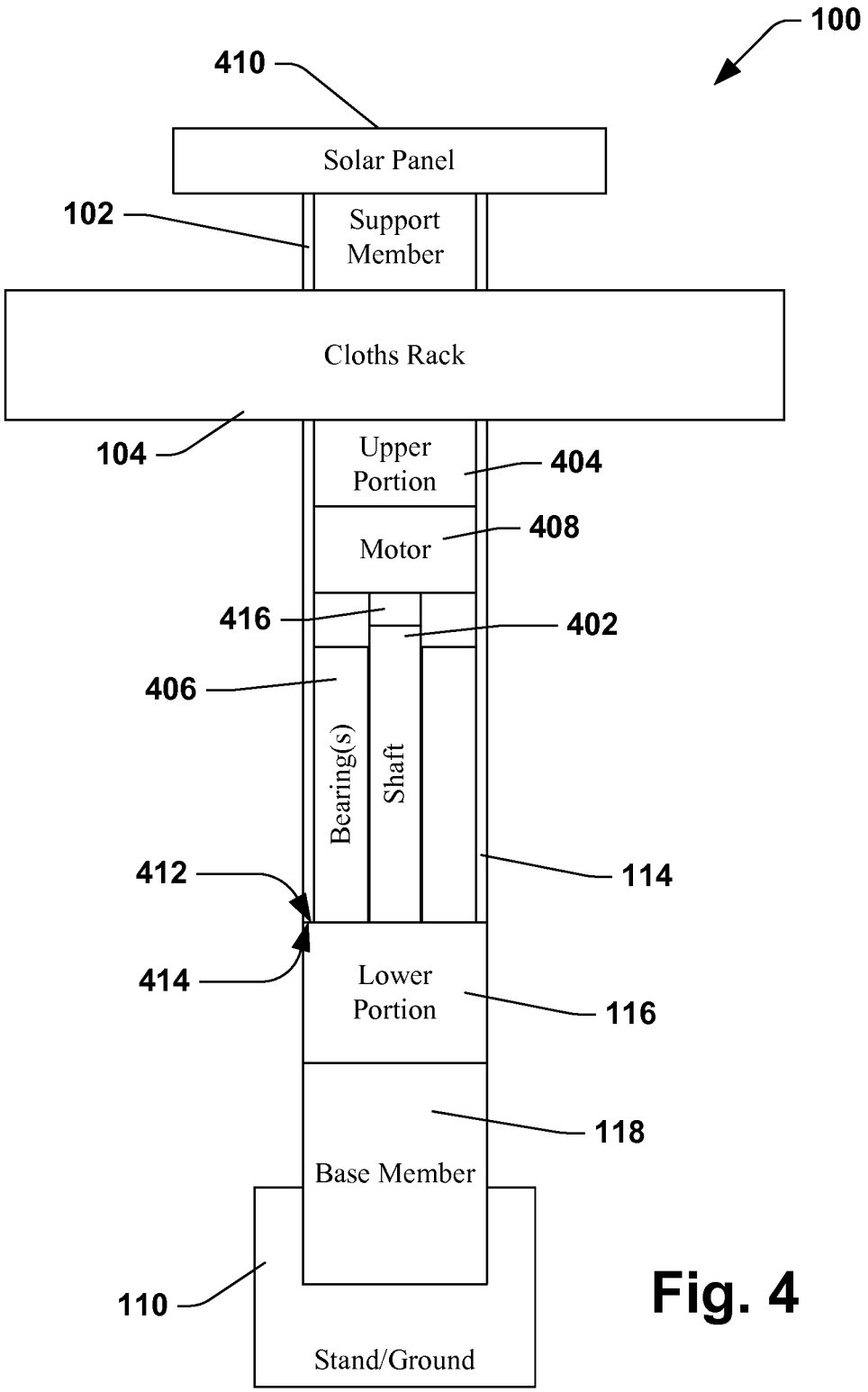
FIG. 4 is a functional block diagram of components of an example embodiment of a clothes drying device.

As discussed previously, an example embodiment of the described clothes drying device 100 is operative to enable its rack 104 to rotate (i.e., spin) with respect to the foundation 110 to which it is mounted. FIG. 4 illiterates a functional block diagram of features of the device 100 which enable the rack to rotate. In this described example, the lower portion 116 of the support member 102 may include a shaft 402 that extends upwardly into the upper portion 114 of the support member.

The upper portion 114 may correspond to a tube that includes an inner cavity 404. The inner cavity 404 may include mounted therein one or more bearings 406 such as a journal bearing and/or one or more sets of ball bearings. The shaft 402 may extend upwardly through the bearings 406.

In addition, the inner cavity 404 may include a motor 408 mounted therein that is in operative connection with the shaft 402. Further, in this described example, the clothes drying device 100 may include a solar panel 410 that is mounted to the upper portion 114 of the support member 102. Such a solar panel may be comprised of one or more photovoltaic solar cells capable of generating an electrical current responsive to light radiation from sunlight or other sources. The motor 408 may be operative responsive to electrical power generated by the solar panel 410 to cause the rack 104, the solar panel 410, and the upper portion 114 of the support member to rotate with respect to the shaft 402 of the lower portion 116 of the support member.

In example embodiments, the motor may correspond to a DC motor having a spindle 416 that extends therefrom. The shaft and spindle may be cooperatively adapted to engage with each other such that rotation of the spindle 416 of the motor causes the shaft 402 to rotate. In an example embodiment, the motor may be adapted via one or more gears to be operative to rotate the shaft at several rpms responsive to the electrical power produced by the solar panel from sunlight.

Figure 5:
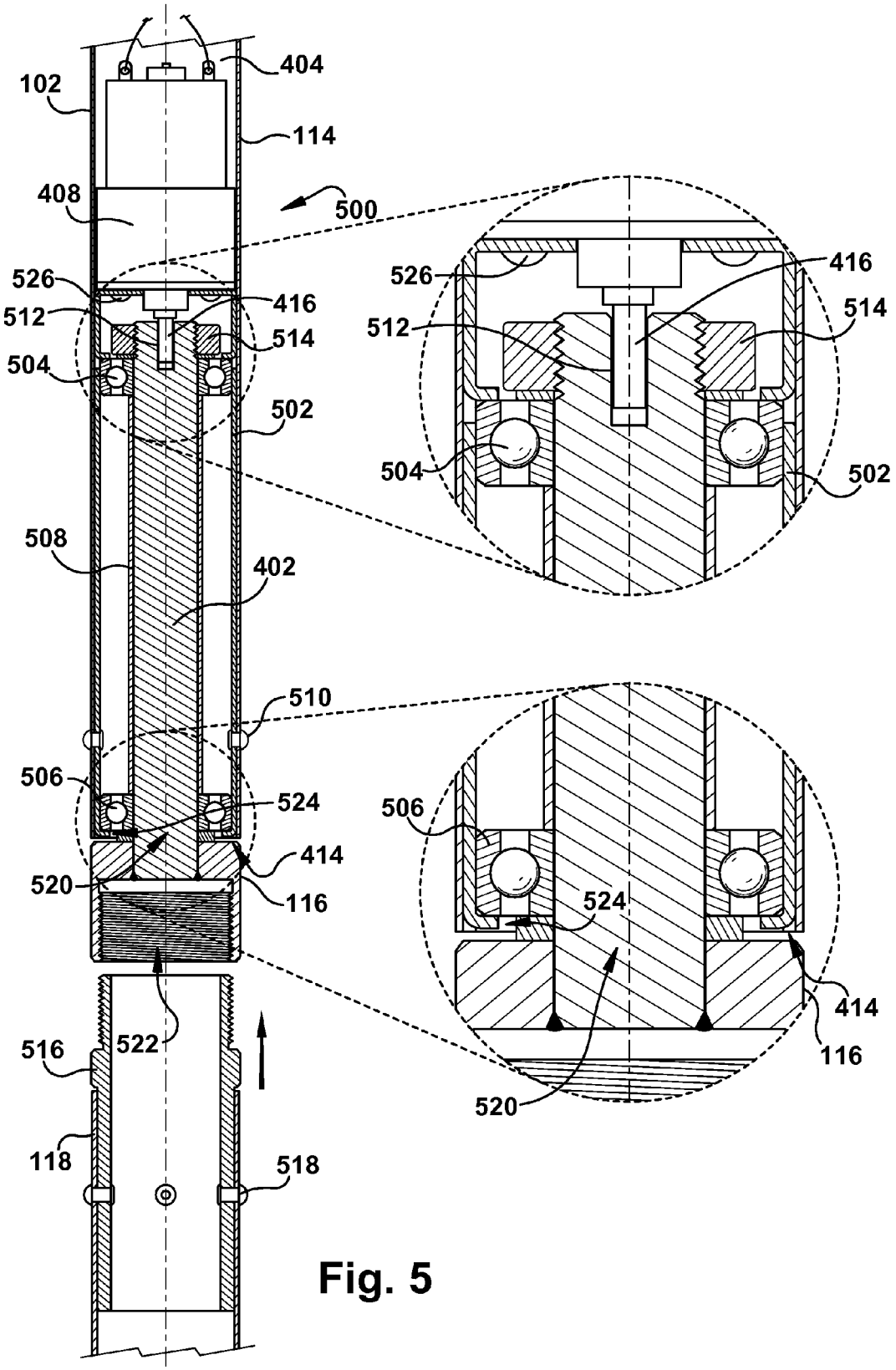
FIG. 5 is a cross-sectional view of a portion of an example embodiment of the clothes drying device.

In this described embodiment, the lower portion 116 of the support member may include an upwardly facing surface 412 from which the shaft 402 extends in an axial direction therefrom. The upwardly facing surface may have an outer diameter that is larger than the diameter of the shaft. In addition, a lower end of the upper portion 114 of the support member may include a downwardly facing surface 414. Such a downwardly facing surface 414 may include a centrally located opening 520 (e.g., a bore as shown in FIG. 5) through which the shaft extends therethrough into the interior area 404 of the upper portion 114 of the support member. In this described embodiment, the upwardly facing surface 412 may be spaced apart from the downwardly facing surface 414. However, in further embodiments the upwardly facing surface 412 may be in sliding contact with the downwardly facing surface 414 when the upper portion 114 of the support member rotates with respect to the lower portion 116 of the support member.

Referring now to FIG. 5, there is illustrated a further example 500 of features that implement the rotation of the upper portion 114 of the support member relative to the lower portion 116 of the support member. As shown in FIG. 5, the interior area 404 of the upper portion 114 of the support member, may include a motor connection tube 502. The motor connection tube may be mounted in releasably fixed relation inside the upper portion 114 of the support member via suitable fasteners such as screws or bolts 510 extending therein. The motor connection tube may also include an upper end that is fastened (e.g. via screws/bolts 526) to the motor 408.

In this example embodiment, the previously described downwardly facing surface 414 may correspond to a lower edge of the motor connection tube 502 and/or a lower edge of the upper portion 114 of the support member. Also, in this example embodiment, the motor connection tube 502 may include two spaced apart ball bearing sets 504, 506 therein. A bearing limit tube 508 may be mounted between the ball bearing sets 504, 506 to maintain the ball bearing sets in spaced apart relation. The shaft 402 extends through the ball bearing sets 504, 506 and the bearing limit tube 508.

As shown in FIG. 5, the motor connection tube may include bent tabs 524 (or other portions or fasteners) that extend inwardly adjacent the lower edges of the lower most ball bearing set 506. As a result the motor connection tube is operative to mechanically prevent the bearing sets 506, 508 and other elements inside the upper portion of the support member from sliding out of the interior area 404 of the upper portion 114 of the support member.

Figure 6:
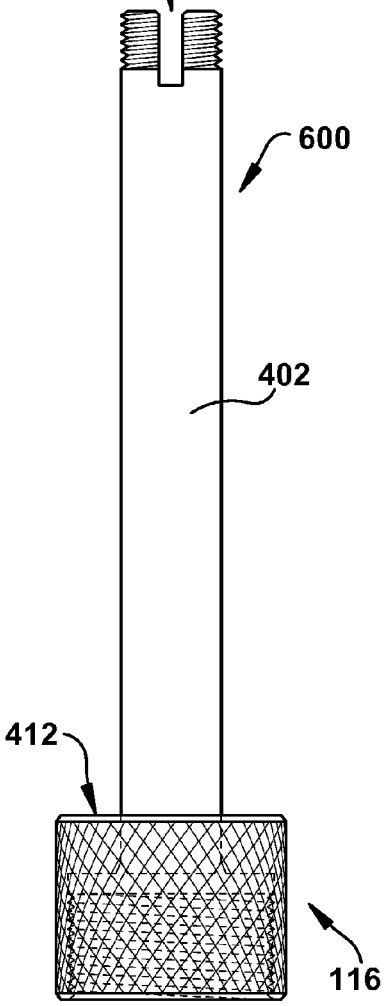
FIG. 6 is a cross-sectional view of the lower portion of the support member.

As discussed previously, the spindle 416 of the motor 408 is operative to engage with the shaft 402. To facilitate this engagement, as shown in FIG. 5, the shaft may include a slot 512 and the spindle 416 of the motor 408 may include a rectangular end that is operative to extend in the slot. FIG. 6 shows an example 600 of the lower portion 116 of a support member showing the shaft 402 with this described slot 512. Also as shown in FIG. 6, the end of the shaft adjacent the slot may be a threaded end having a plurality of threads adapted to receive a nut 514 (shown in FIG. 5). Such a nut may have a diameter that is larger than the inner diameter of an adjacent washer, ball bearing set 504, or other internal member, so as to mechanically prevent the shaft from being pulled out of the upper portion of the support member.

As shown in FIG. 5, the lower portion 116 of the support member may include an internally threaded bore 522. To facilitate mounting the lower portion 116, the device may include a connecting member 516 having a threaded end that is adapted to cooperatively engage with the threaded bore 522 of the lower portion 116 of the support member. Such a connection member may have an opposite end having an inner diameter sized to slide into an extension member 118 that provides additional height to the device and is operative to be mounted into a foundation 110 such as the ground or a stand. The extension member 516 may be rigidly locked to the extension member 118 via suitable fasteners 518 such as screws or bolts.

Figure 7:
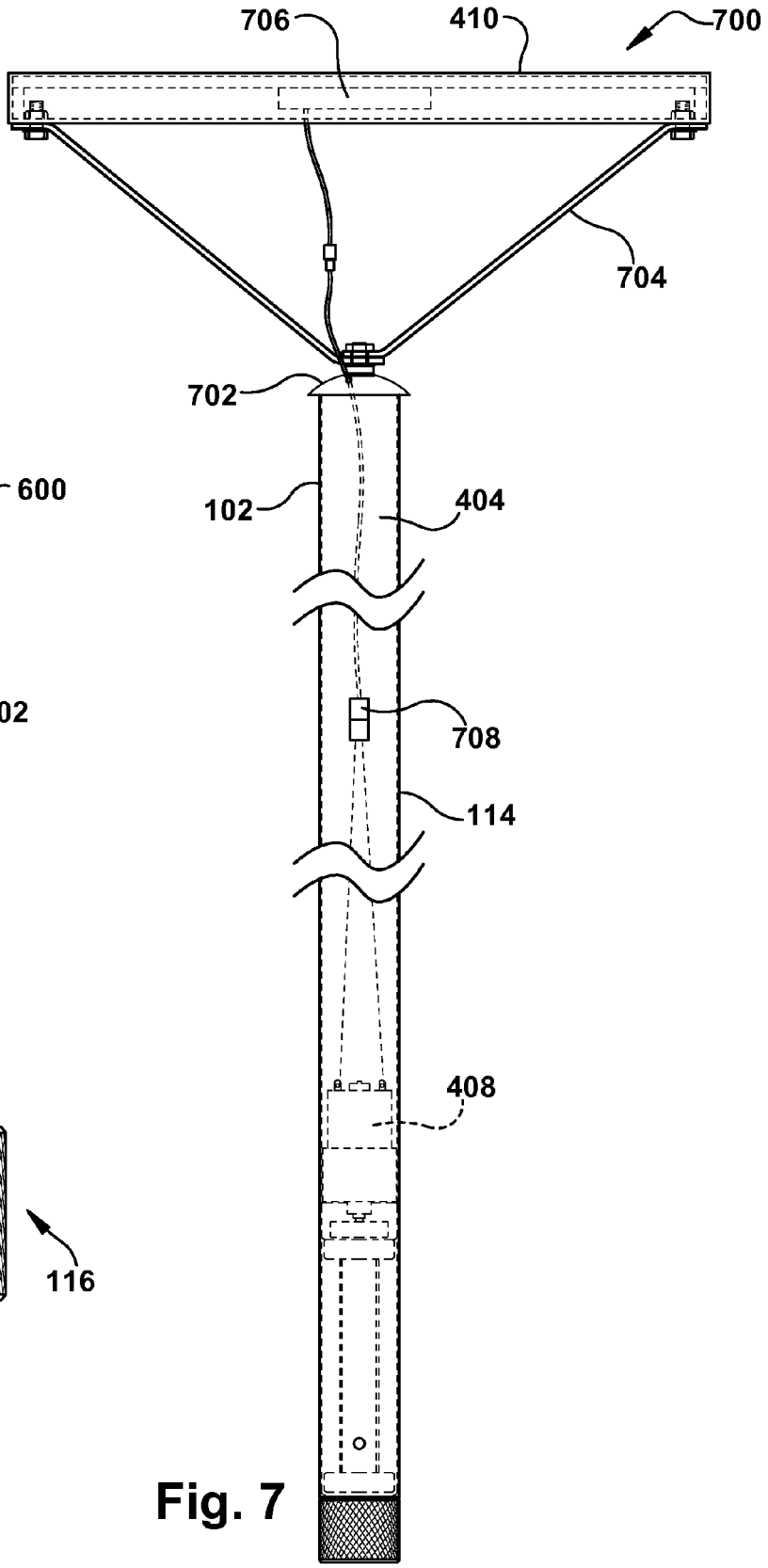
FIG. 7 is a schematic cross-sectional view of a portion the clothes drying device that includes a solar panel.

FIG. 7 shows a further view of the upper potion 114 of the support member. As shown in FIG. 7, the upper portion 114 of the support member may include an apex 702. In this example, the clothes drying device may include a bracket 704 adapted to mount the solar panel 410 to the apex 702 such that the solar panel extends above the rack when the rack is in the expanded open position as shown in FIG. 1. FIG. 7 also illustrates an example location of a power supply control system 706 which may include a control circuit and/or battery that is operative to regulate the supply of electrical power between the solar panel and motor. However, it should be appreciated that the power supply control system 706 may be located in other locations on the device such as within the upper portion 114 of the support member.

In addition, example embodiments of the described clothes drying device may include a switch 708 mounted to the upper portion 114 of the support member. Such a switch may be operative to selectively open and close an electrical circuit that provides electrical power generated by the solar panel to the motor.

In example embodiments, the solar panel 410 may have a single solar cell or a sufficient number of solar cells to produce electrical power that is sufficient to cause the motor 408 to rotate the rack between 2-5 rpms responsive to direct sunlight. For example, in an embodiment, the solar panel 410 may include one or more multicrystalline silicon solar cells capable of outputting 12 volts DC. For example, such a solar panel may be configured in a rectangle with an upper surface with dimensions of 40.5 cm×12 cm and with three solar cells arranged therein. Also, the motor 408 may correspond to a 12 Volt 5 Watt DC gear motor capable of rotating a spindle at 5 RPM.

However, it should be appreciated that alternative embodiments may use other sizes and types of solar cells and motors. For example alternative embodiments may use monocrystalline silicon solar cells or solar cells comprised of other materials. Also, alternative embodiments may use larger or smaller motors with different rotational speed capabilities and power requirements.

In addition, in alternative embodiments, the power supply control system 706 of the solar panel may include a battery which is operative to store electrical power transmitted between the solar panel and motor. However, other embodiments may not include a control circuit and/or a battery.

Referring back to FIG. 1, as discussed previously, the collar member 122 is operative to slide along the upper portion 114 of the support member. However, in example embodiments, the head portion 120 may also correspond to a further collar member that is operative to be selectively moved along the upper portion of the support member between relatively lower and higher positions. In example embodiments, movement of both the collar member 122 and head member 120 relatively lower or higher may allow a user to place the rack at a suitable height that is more comfortable to add clothing articles to the clothes lines 106. In addition, by lowering both the head member and collar member along the support member, the relative height of the device in the compacted closed position shown in FIG. 2 may be reduced for easier storage and packaging.

In addition, it should be appreciated that the location of the junction between the upper portion 114 and lower portion 116 of the support member may be higher than shown in FIG. 1. For example, the motor 408, shaft 402, and associated features described with reference to FIG. 5, may be located closer to the apex 702.

Figure 8:
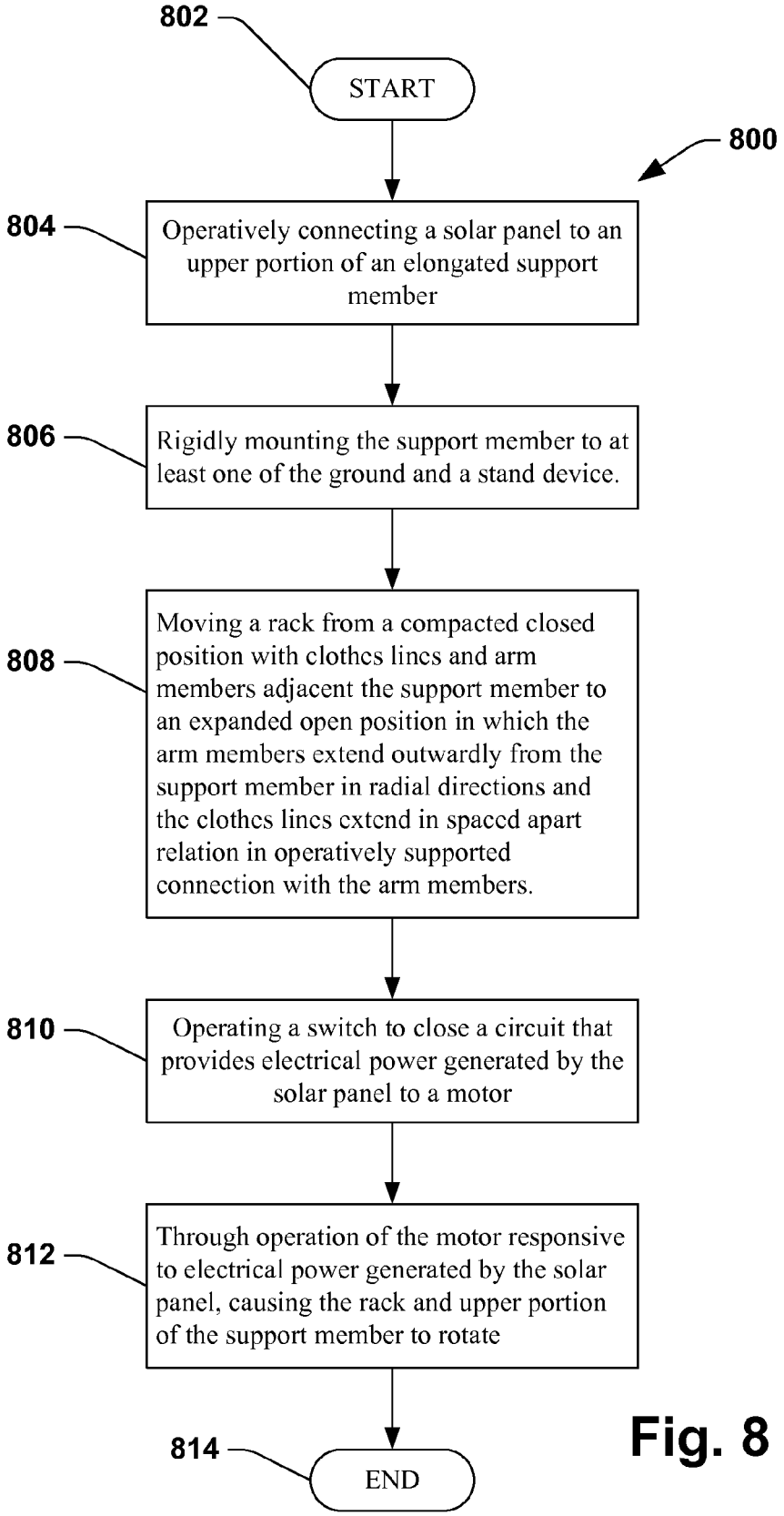
FIG. 8 is a flow diagram that illustrates an example methodology for operating an example embodiment of a clothes drying device.

With reference now to FIG. 8, an example methodology is illustrated and described associated with the operation of one or more of the previously described examples of the clothes drying device. While the methodology is described as being a series of acts that are performed in a sequence, it is to be understood that the methodologies are not limited by the order of the sequence. For instance, some acts may occur in a different order than what is described herein. In addition, an act may occur concurrently with another act. Furthermore, in some instances, not all acts may be required to implement a methodology described herein.

As illustrated in FIG. 8, the methodology 800 begins at 802, and at 804 includes a step of operatively connecting a solar panel to an upper portion of an elongated support member. As discussed previously, the support member includes a lower portion. A rack is in operative connection with the upper portion of the support member. The rack includes a plurality of arm members and a plurality of lines in operatively supported connection with the arm members. The arm members are operative to extend outwardly from the support member in radial directions such that the lines extend in spaced apart relation around the support member. In addition, as described previously the upper portion of the support member includes a motor mounted therein. Also, a shaft extends downwardly from the motor to the lower portion of the support member.

Continuing at step 806, the methodology may include a step of rigidly mounting the support member to at least one of the ground and a stand device. The methodology may also include a step 808 of moving the rack from a compacted closed position with the clothes lines and arm members adjacent the support member to an expanded open position in which the arm members extend outwardly from the support member in radial directions and the clothes lines extend in spaced apart relation in operatively supported connection with the arm members.

Continuing at step 810, the methodology may include operating a switch to close a circuit that provides electrical power generated by a solar panel to the motor. After engagement of the switch, the methodology may include a step 812 in which the motor causes the rack and upper portion of the support member to rotate (with respect to the lower portion of the support member) responsive to electrical power generated by the solar panel.

In general, the methodology 800 corresponds to the initial setup of an example clothes drying device by a user. Once the device has been set up, a user may mount clothing articles to the clothes lines using clothes pins or other fasteners. The described switch may be operated to start and stop the rotation of the rack in order to remove and/or add articles of clothing to the clothes lines.

In addition, it should be appreciated that the one or more of the described principles and features described herein related to rotating a rack using a motor powered via a solar panel, may be applied to alternative embodiments of a clothing drying device. For example, the described embodiments of the clothes drying device may include the support arm, and strut members made out of metal such as aluminum and/or steel. However, alternative embodiments may be comprised out of bamboo or other type of wood. In addition, in the described embodiment, the motor is mounted inside the upper portion of the support member. However, in alternative embodiments, the motor may be installed in the lower portion of the support member. Also as described previously, the solar panel may be mounted to the apex of the support member. However, in alternative embodiments, the solar panel (or multiple solar panels) may be mounted in other or additional locations, such as on the arm members.

It is noted that several examples have been provided for purposes of explanation. These examples are not to be construed as limiting the hereto-appended claims. Additionally, it may be recognized that the examples provided herein may be permutated while still falling under the scope of the claims.

What is claimed is:

1. A clothes drying device comprising:

an elongated support member, wherein the elongated support member includes an upper portion and a lower portion, wherein the upper portion of the support member includes a lower end with an opening therethrough, wherein the lower portion of the support member includes a shaft that extends into the upper portion of the support member, wherein the lower portion of the support member includes an upwardly facing surface from which the shaft extends in an axial direction therefrom, wherein the upwardly facing surface has an outer diameter that is larger than the diameter of the shaft;

a rack in operative connection with the upper portion of the support member, wherein the rack includes a plurality of arm members and a plurality of clothes lines in operatively supported connection with the arm members, wherein the arm members are operative to extend outwardly from the support member in radial directions such that the clothes lines extend in spaced apart relation around the support member;

a motor mounted within the upper portion of the support member and in operative connection with the shaft, wherein the motor includes a spindle, wherein the shaft extends through the opening in the lower end of the upper portion of the support member and into operative engagement with the spindle of the motor;

a solar panel adapted to mount to the upper portion of the support member, wherein the motor is operative responsive to electrical power generated by the solar panel to cause the rack, solar panel, and upper portion of the support member to rotate with respect to the shaft of the lower portion of the support member.

2. The device according to claim 1, wherein the rack includes:

a head member in operative connection with the upper portion of the support member; and a collar member in surrounding relation around the upper portion of the support member, wherein the collar member is operative to slide along the support member between a first lower position and a second higher position that is relatively closer to the head member;

wherein the arm members are pivotally connected to the collar member, wherein the rack includes a plurality of strut members pivotally connected to the head member, wherein each strut member is pivotally connected to a respective one of the plurality of arm members, wherein the clothes lines are flexible;

wherein when the collar member is in the first lower position, the rack is in a compacted closed position with the clothes lines, the arm members, and the strut members adjacent the support member, wherein when the collar member is in the second upper position, the rack is in an expanded open position in which the arm members and strut members extend outwardly from the support member in radial directions and the clothes lines extend in spaced apart relation in operatively supported connection with the arm members.

3. The device according to claim 2, wherein the head member is in surrounding relation around the upper portion of the support member, wherein the head member is operative to slide along the support member between a third lower position and a fourth higher position.

4. A clothes drying device comprising:

an elongated support member, wherein the elongated support member includes an upper portion and a lower portion, wherein the lower portion includes a shaft that extends into the upper portion, wherein the lower portion of the support member includes an upwardly facing surface from which the shaft extends in an axial direction therefrom, wherein the upwardly facing surface has an outer diameter that is larger than the diameter of the shaft, wherein the lower portion of the support member includes an internally threaded bore;

a connection member, wherein the connection member includes a threaded end, wherein the threaded bore of the lower portion of the support member is adapted to receive the threaded end of the connection member in cooperatively threaded connection;

an extension member, wherein the connection member includes a further end adapted to slide into the extension member;

a rack in operative connection with the upper portion of the support member, wherein the rack includes a plurality of arm members and a plurality of clothes lines in operatively supported connection with the arm members, wherein the arm members are operative to extend outwardly from the support member in radial directions such that the clothes lines extend in spaced apart relation around the support member;

a motor mounted within the upper portion of the support member and in operative connection with the shaft;

a solar panel mounted to the upper portion of the support member, wherein the motor is operative responsive to electrical power generated by the solar panel to cause the rack, solar panel, and upper portion of the support member to rotate with respect to the shaft of the lower portion of the support member.

5. The device according to claim 1, wherein the lower end of the upper portion of the support member includes a downwardly facing surface that is spaced apart from the upwardly facing surface of the lower portion of the support member.

6. The device according to claim 5, further comprising a motor connection tube extending within the upper portion of the support member, wherein the motor connection tube includes two spaced apart ball bearing sets therein, with a bearing limit tube therein which maintains the ball bearing sets in spaced apart relation, wherein the shaft extends through the ball bearing sets.

7. The device according to claim 1, wherein the shaft includes a slotted end, wherein the spindle of the motor extends into the slot of the shaft such that the operation of the motor causes the rack, solar panel, and upper portion of the support member to rotate with respect to the shaft.

8. The device according to claim 7, further comprising a nut in threaded connection with the slotted end of the shaft, wherein the nut is operative to prevent ball bearing sets from sliding off of the shaft.

9. The device according to claim 1, wherein the motor is a DC gear motor, wherein the solar panel is operative responsive to sunlight to generate an amount of electrical power sufficient to cause the motor to rotate the rack relative the lower portion of the support member at a rotational rate of between 2 and 5 rpm.

10. The device according to claim 1, wherein the upper portion of the support member includes an apex, further comprising a bracket adapted to mount the solar panel to the apex such that the solar panel extends above the rack when the rack is in the open position.

11. The device according to claim 1, wherein the upper portion of the support member includes a switch that is operative to selectively open and close an electrical circuit that provides electrical power generated by the solar panel to the motor.

12. A method of operating the clothes drying device according to claim 1, comprising:

through operation of the motor responsive to electrical power generated by the solar panel mounted to the upper portion of the support member, causing the rack and the upper portion of the support member to rotate with respect to the shaft and the lower portion of the support member.

13. The method according to claim 12, wherein the clothes lines are flexible, further comprising:

operatively connecting the solar panel to the upper portion of the support member;

moving the rack from a compacted closed position with the clothes lines and the arm members adjacent the support member to an expanded open position in which the arm members extend outwardly from the support member in radial directions and the clothes lines extend in spaced apart relation in operatively supported connection with the arm members.

14. The method according to claim 13, further comprising:

engaging a switch to close a circuit that provides electrical power generated by the solar panel to the motor.

15. The method according to claim 14, further comprising:

mounting the lower portion of the support member into operative connection with an elongated base member;

rigidly mounting the base member to at least one of the ground and a stand device.

16. The device according to claim 1, wherein the solar panel is mounted to the upper portion of the support member such that the solar panel is operative to provide electrical power to the motor in order to cause the rack, solar panel, and upper portion of the support member to rotate with respect to the shaft and the lower portion of the support member.

* * * * *